United States Patent [19]

Hodges

[11] Patent Number: 4,575,155

[45] Date of Patent: Mar. 11, 1986

[54] PRESSURE DIFFERENTIAL MINING TOOL

[76] Inventor: Everett L. Hodges, 49 Royal St. George, Newport Beach, Calif. 92660

[21] Appl. No.: 588,211

[22] Filed: Mar. 12, 1984

[51] Int. Cl.[4] ..... E21C 37/06

[52] U.S. Cl. ..... 299/17; 175/67; 175/215

[58] Field of Search ..... 299/4, 5, 11, 16, 17; 175/67, 213, 215, 422; 166/222, 285

[56] References Cited

U.S. PATENT DOCUMENTS

| | | | |
|---|---|---|---|
| 1,820,917 | 9/1931 | Langford . | |
| 1,851,565 | 3/1932 | Claytor | 299/17 |
| 2,316,005 | 4/1943 | Lachle | 260/428 |
| 2,745,647 | 5/1956 | Gilmore | 299/5 |
| 2,772,868 | 12/1956 | Brandt | 299/5 |
| 3,017,342 | 1/1962 | Bulat et al. | 208/11 |
| 3,068,167 | 12/1962 | White | 208/11 |
| 3,159,562 | 12/1964 | Bichard et al. | 208/11 |
| 3,349,843 | 10/1967 | Huitt | 166/271 |
| 3,455,392 | 7/1969 | Prats | 166/303 |
| 3,497,005 | 2/1970 | Pelopsky | 166/247 |
| 3,556,597 | 1/1971 | Porter | 175/67 |
| 3,556,980 | 1/1980 | Clark | 208/11 |
| 3,560,371 | 2/1971 | Kaminsky | 208/11 |
| 4,096,057 | 6/1978 | Porritt et al. | 208/11 |
| 4,130,474 | 12/1978 | Anthony | 208/11 |
| 4,275,926 | 6/1979 | Hodges | 299/17 |
| 4,289,354 | 9/1981 | Zakiewicz | 299/11 |
| 4,296,970 | 2/1980 | Hodges | 299/67 |
| 4,324,652 | 10/1980 | Hack | 209/3 |
| 4,366,988 | 1/1983 | Bodine | 299/17 |
| 4,406,499 | 9/1983 | Yildirim | 299/17 |
| 4,415,206 | 11/1983 | Hodges | 299/17 |

*Primary Examiner*—Stephen J. Novosad
*Assistant Examiner*—William P. Neuder
*Attorney, Agent, or Firm*—Hubbard, Stetina & Brunda

[57] ABSTRACT

A pressurized fluid is injected into a subterranean cavity in a mineral deposit to support the overburden during hydraulic mining operations. A dynamic seal between the drill string and a surrounding casing retains fluid pressure within the cavity as the drill string rotates during mining operations. A blowout protector retains fluid pressure within the cavity while the drill string is raised or lowered within the cavity when it is necessary to add or remove drill string sections.

6 Claims, 3 Drawing Figures

PRESSURE DIFFERENTIAL MINING TOOL

BACKGROUND OF THE INVENTION

The present invention relates generally to hydraulic mining particularly to an improved hydraulic mining tool and method of hydraulically mining unconsolidated mineral formations such as tar sands.

Recent technology has been developed which permits the recovery of subterranean mineral deposits by use of hydraulic mining techniques. Hydraulic mining techniques basically involve the use of a high velocity liquid stream discharged directly into the subterranean mineral deposit to dislodge minerals from their surrounding mineral bed. The freed minerals and the discharged liquid stream form a resultant slurry that may be pumped by conventional pumping apparatus upward to ground surface for subsequent processing by surface separation systems. As the slurry is removed from the mineral formation, a mining cavity, or void, is formed in the mineral bed which, dependent upon the size and type of the particular formation, may extend to 100 feet in diameter throughout the height of the mineral bed. Examples of such hydraulic mining tools are disclosed in U.S. Pat. No. 3,951,457 issued to Redford and U.S. Pat. No. 3,439,953 issued to Pfefferle and my U.S. Pat. No. 4,275,926, the disclosures of which are hereby incorporated herein by reference.

To date, such hydraulic mining techniques have been primarily utilized to recover minerals such as uranium, coal, or potash, which typically possess sufficient consolidation in their natural formation state so that the mining cavity or void is formed in the subterranean formation, the surrounding mineral bed remains in its stabilized consolidated condition, thereby defining a "clean" mining cavity. Thus, in such consolidated formations, the overburden is continuously supported by the consolidated mineral bed and the hydraulic mining tool may be freely rotated and vertically reciprocated within the borehole and mining cavity throughout the mining process. However, in the hydraulic mining of unconsolidated mineral formations where the overburden is also unconsolidated, unique mining problems exist, which to a great extent have rendered the existing hydraulic mining tool technologyp potentially commercially uneconomical because of the caving of nonmineral-bearing overburden into the cave-in and mixing with the ore, thus decreasing the value of mined materials brought to the surface.

In contrast to the above-mentioned consolidated mineral formations, unconsolidated formations such as tar sands, typically are non-uniform in composition and often fail to possess the necessary degree of integrity and stabilization to maintain a cap over the mining cavity during the hydraulic mining operation. Failure of the unconsolidated overburden formations and, in particular, barren overburden has a serious effect on the economics of subterranean mining when the overburden cavens in and mixes with the ore. The compressive forces generated by the weight of the unconsolidated overburden will cause a cave-in effect as the ore body is being mined. As the subjacent portions of the tar sand mineral bed are removed during the hydraulic mining process, the overburden compressive force balance within the mineral formation is disturbed which, due to only minimal cementation integrity between the individual overburden sand grains, often results in a "cave-in" or "compaction" whereby the surrounding mineral bed catastrophically falls into the mining cavity and around the mining device.

When hydraulically mining in relatively shallow unconsolidated formations approximately 100 feet below ground surface, the removal of the mineral bed often permits the overburden to migrate downward into the borehole and the mining cavity, wherein it mixes with the mined mineral slurry and is subsequently transported upward to ground surface during the mining process. As will be recognized, the mining of the nonmineral bearing overburden reduces the overall efficiency of the mining process. Substantial mining of the overburden decreases the cost effectiveness of the hydraulic mining process to a degree such that the process is commercially infeasible. Further, in those instances where the downward migration of the overburden is acute, a general subsidence of the overburden may be experienced whereby the overburden fails to support the necessary surface mining equipment.

Alternatively, when mining in deep unconsolidated mineral formations (i.e., greater than 500 feet below ground surface), individual sand grains located proximate the borehole often dislodge from the mineral bed by frictional drag forces exerted by the rotating mining tool and drill string. Through prolonged duration, these frictional drag forces often disturb the fragile cementation forces existing between sand grains and result in the entire surrounding mineral bed falling in and compacting around the mining tool. Due to the depth at which the mining operation is occurring, substantial pressure is applied along the entire length of the mining tool. A partial collapse of the overburden could cause a canting of the mining tool, producing pressures on the sides thereof sufficient to prevent rotation of the mining tool, thus requiring intermittent shut-down of the drilling operation. In extreme instances collapses of the overburden have caused a complete structural failure or twist off of the mining tool within the formation. Such intermittent discontinuance of the mining operation significantly decreases overall operating efficiency while a twist-off condition typically results in the mining tool being irretrievably lost within the mineral formation.

The present inventor's copending U.S. patent application, Ser. No. 467,496, filed Feb. 18, 1983, and entitled APPARATUS AND METHOD OF HYDRAULICALLY MINING CONSOLIDATED MINERAL FORMATIONS, now abandoned, hereby incorporated by reference herein, discloses a hydraulic mining tool that includes means for injecting a suitable liquid bonding agent radially outward in the overburden formation from a borehole. The bonding agent cures to form a generally disc-shaped stabilized zone of overburden around the borehole above the mining cavity. The stabilized zone forms a rigid platform that artificially increases the cementation forces existing between the individual particles in the overburden, thereby increasing the suport of the overburden and preventing downward migration of the overburden during the mining operations. However, experience has shown that efficient hydraulic mining of some mineral deposits, particularly certain tar sands deposits, requires even more support of the overburden than is ordinarily possible by injecting a bonding agent from the mining tool radially outward into the mineral formation.

Thus, there exists a substantial need in the art for an improved hydraulic mining method and apparatus specifically adapted for use in unconsolidated mineral formations to prevent downward migration of the overburden, reduce frictional drag forces exerted on the mineral bed, and prevent generation of extremely high torsional forces on the mining tool during the hydraulic mining operation.

SUMMARY OF THE INVENTION

The present invention comprises an improved apparatus and method of hydraulically mining which specifically addresses and alleviates the above-referenced deficiencies associated with the hydraulic mining of unconsolidated mineral formations. More particularly, the present invention provides an apparatus and method for using fluid pressure in the mining cavity and borehole to support an artificially consolidated, stabilized region or zone extending radially outward into the formation in a generally disc-shaped configuration adjacent the overburden mineral bed interface.

In the preferred embodiment, the stabilized zone is formed by injecting a suitable liquid bonding agent radially outward in the formation. After a sufficient curing period, the bonding agent bonds the individual overburden particles together to yield a consolidated, stabilized region above the ore body. By such a procedure, the stabilized region forms a rigid platform having artificially increased cementation forces between the individual formaion particles to increase the support of the overburden and prevent the downward migration of the overburden during mining operations. After the bonding agent has cured, a seal is formed around the mining tool and pressurized fluid is injected into the mining cavity below the stabilized zone. A predetermined pressure is maintained in the mining cavity throughout mining operations to support the overburden and above-ground equipment employed in the mining operations. A blowout prevention device maintains pressurization within the cavity during removal of the mining tool from the cavity and during return of the mining tool into the cavity.

BRIEF DESCRIPTION OF DRAWINGS

These and other features of the present invention will become more apparent upon reference to the drawings, wherein.

DESCRIPTION OF THE PREFERRED EMBODIMENT

Figure 1:
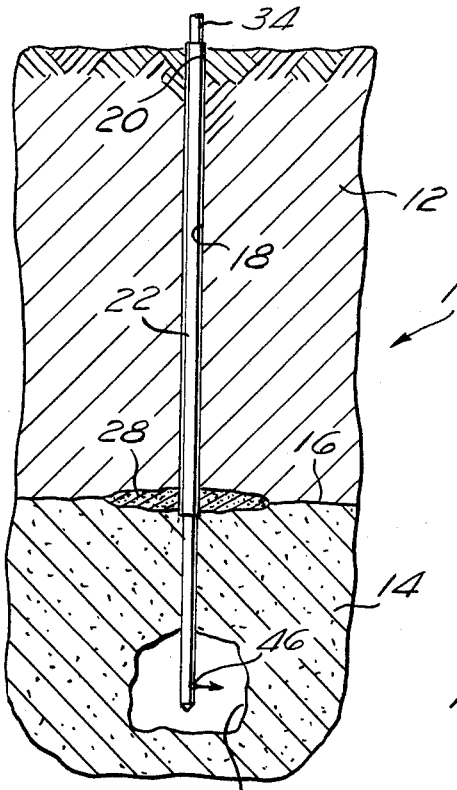
FIG. 1 is a cross-sectional view taken through a mineral formation depicting the overburden and mineral bed and illustrating a borehole from a ground surface to a depth adjacent the interface between the overburden and mineral bed.

Referring to FIG. 1, there is shown a mineral formation 10 composed generally of an overburden 12 and a mineral bed 14, which by way of example, may comprise an unconsolidated tar sand formation. The overburden 12 and the mineral bed 14 are shown to have an interface 16 therebetween. Preparatory to the actual hydraulic mining operation, the initial step in the method of the present invention is formation of a borehole 18 which has an open end 20 at ground surface and which preferably extends a short distance beyond the interface 16 between the overburden 12 and the mineral bed 14. The borehole 18 may be formed by any conventional method, but in the preferred embodiment, the borehole 18 is formed by use of a conventional tri-cone bit sized to yield an effective borehole diameter of approximately 26 inches.

Subsequent to the formation of the borehole 18, a tubular drill casing 22 having, in the illustrated embodibment, outside diameter slightly less than the diameter of the borehole 18 is inserted therein to extend from the opening 20 to a position adjacent the lower end of the borehole 18. In a preferred embodiment of the invention, the casing 22 is a standard casing having an inside diameter of approximately 24 inches. The casing 22 is preferably formed of metal or a cement-like material and is maintained stationary within the formation 10 and centered within the borehole 18 by conventional means, such as the centralizer baskets 21 or casing shoes (not shown). Since the casing 22 extends throughout the length of the overburden 12, installation of the casing 22 substantially eliminates problems caused by overburden 12 falling into the borehole 18.

Figure 2:
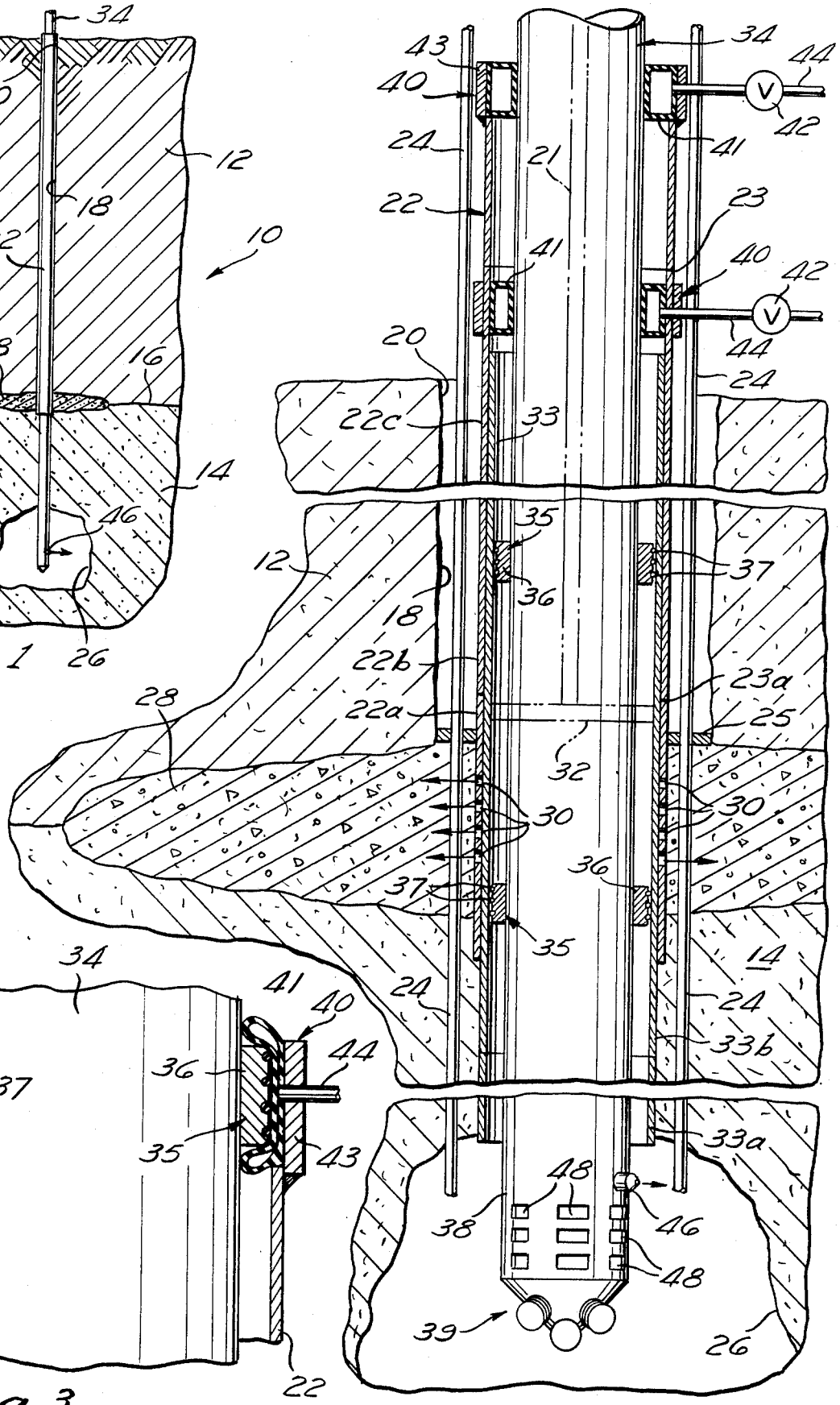
FIG. 2 is an enlarged cross-sectional view taken about the interface between the overburden and mineral bed of FIG. 1 and depicting the manner in which the stabilized consolidated region is formed in the formation and the manner in which a fluid pressure is maintained in the mining cavity and borehole.

The casing 22 is preferably formed of a plurality of 20-foot casing sections **22*a*, 22*b*, 22*c*, etc. as shown in FIGS. 1 and 2. The 22*a*, 22*b*, etc., casings preferably are joined together by threaded interior and exterior flush joints 23. The lowermost joint 23*a* is preferably reverse threaded from the other joints 23 to permit the upper casing sections to be unscrewed from the lowermost casing section 22*a***.

After implacement of the casing 22, at least one, and preferably a plurality of conduits 24 are lowered into the borehole 18 outside the casing 22. The conduits 24 extend through the overburden 12 and the upper portion of the mineral deposit 14 into a mining cavity 26. The conduits 24 may be formed of any material such as metal pipes suitable for conducting high pressure fluid into the cavity 26.

Subsequent to the implacement of the casing 22 and the conduits 24, preferably the next step of the present invention is the formation of an artificially stabilized or consolidated zone 28 adjacent the interface 16 between the overburden 12 and mineral bed 14 to provide subjacent support for the overburden 12 during the mining process. Referring to FIGS. 1 and 2, the casing section **22*a* adjacent its lowermost end has a plurality radially outward of apertures 30 extending therethrough. The apertures 30 may be formed in the casing section 22*a* either during manufacture of the casing and, hence, prior to insertion of the casing 22 within the borehole 18 or subsequently after the casing section 22*a* is set in the formation 10 by use of conventional gun perforation or other downhole perforation techniques. As best shown in FIG. 2, the apertures 30 are preferably spaced from the lowermost end of the drill casing 22 and positioned so as to be in the general plane of or slightly above the overburden/mineral bed interface 16**.

An expandable packer 32 indicated by the phantom lines in FIG. 2 is inserted downward from ground surface through the length of the casing 22 and rigidly positioned at the lowermost end thereof. The mechanical packer 32 is well-known in the art, and in this particular application, completely closes off, or blocks, the uppermost end of the casing section **22*a* vertically above the apertures 30. The mechanical packer 32 is lowered into the casing via a suitable tubing 23. Rotation of the mechanical packer 32 in one direction expands it to seal against the wall of the casing section 22***a*. A cement retainer 25 is placed around the outside of the casing section 22*a* to prevent material from rising in the borehole above the upper end of the casing section. With the packer 32 implaced within the casing 22, a suitable bonding agent may be pumped under pressure downward from ground surface through the tubing 21 below the mechanical packer 32. The apertures 30 direct the bonding agent radially outward into the formation 10 as indicated by the arrows adjacent the apertures 30 in FIG. 2. With the cement retainer 25 positioned around the casing section 22*a* as described above, controlling the injection pressure and the volume of the bonding agent introduced into the formation sequeezes the bonding agent radially outward into the formation to form the disc-shaped region 28 substantially co-axial with the borehole 18. A variety of bonding agents may be utilized for this purpose. Suitable bonding agents are characterized by remaining substantially pliable or fluid during the initial injection process to sufficiently migrate radially outward into the formation 10 and subsequently cure or harden to bond the injected formation into the substantially rigid consolidated region 28. Examples of such bonding agents are catalyst-activated silica jells such as that currently sold under the names "SAND FIX", a registered trademark of the Halliburton Company for a multi-step organic chemical resin process, or "SAND SET", a registered trademark of the Halliburton Company for a premixed plastic compound which hardens to form a strong impermeable consolidated zone.

In the preferred embodiment, the effective diameter of the artificially consolidated region 28 and, thus, the amount of bonding agent injected into the formation 10, may be predetermined to insure sufficient support for the overburden 12 to permit removal of the amount of mineral bed 14 desired to be mined in the hydraulic mining process. However, for the majority of hydraulic mining applications, it is anticipated that the effective diameter of the consolidated zone 28 will range from approximately 10 to 60 feet to prevent any downward migration or subsidence of the overburden 12 into the mineral bed 14.

Subsequent to the formation of the consolidated region 28, the mechanical packer 32 is removed from the interior of the drill casing 22 and a conventional drilling apparatus such as a tri-cone bit 39 mounted to a mining tool 36 may be lowered downward within the casing 22 and utilized to drill through the bonding agent in the lowerend of the casing section 22*a* and extend or drill the borehole 18 a desired depth into the mineral formation 14.

A drill string 34 is fitted with a plurality of annular dynamic seals 35, which each preferably include a collar 36 connected to the drill string 34 to retain a plurality of O-ring seals 37 between the drill string 34 and a protective sleeve 33. The O-ring seals 37 are formed of a suitable low-friction substance for forming a fluid-tight seal between the drill string 34 and the inside of the protective sleeve 33. The dynamic seals 35 are preferably spaced about 15 feet apart along the length of the drill string 34 within the protective sleeve 33 and permit rotation of the drill string 34 within the protective sleeve 33 while retaining fluid pressure in the cavity 26 and the casing 22. The seals 35 permit rotational and vertical movement of the drill string 34 within the protective sleeve 33 while providing sealing adequate to retain desired pressures inside the cavity 26. The drill string 34 with the hydraulic mining tool 38 mounted to the lower end thereof is inserted into the casing 22 and the protective sleeve 33.

Figure 3:
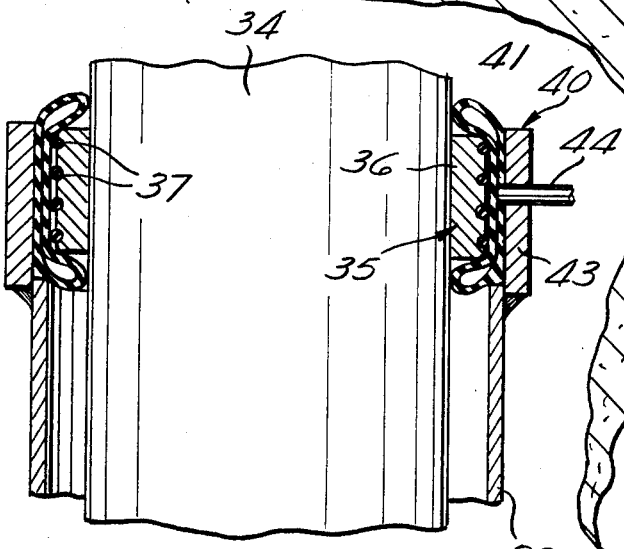

Referring to FIGS. 2 and 3, a pair of blowout protector 40 are mounted near the upper end of the casing 22. The blowout protectors 40 each preferably include an expandable device 41 of a type commonly used in oil wells to maintain fluid pressurization control therein. The balloon device 41 is formed to have a generally annular configuration and is positioned around the drill string 34 and the protective sleeve 33 before inflation through a valve 42 and a pipe 44. A collar 43 mounted to the casing 22 retains the balloon device 41 in compression against the casing 22.

The devices 41 are deflated so that the dynamic seals 35 may be moved past the blowout protector 40 as the drill string is lowered or raised within the borehole 18. As best shown in FIG. 3, each blowout protector 40 completely encloses the dynamic seals 35 between the balloon device 41 and the collar 43 as the drill string 34 is raised or lowered in the casing 22. Therefore, vertical movement of the drill string 22 does not cause a loss of fluid pressure in the borehole 18 or the cavity 26.

After insertion of the drill string 34 with the seals 35 thereon into the sleeve 33 and inflation of the blowout protector 40, a pressurized fluid, such as air from a convenient above-ground source (not shown), is injected through the conduits 24 into the mining cavity 26. It has been fund that a pressure of 0.5 pounds per square inch for each vertical foot of overburden supported should be suitable for preventing the overburden from falling into the mining cavity 26. However, a given formation may require a greater or lesser pressure to adequately support the overburden.

The hydraulic mining tool 38 includes at least one nozzle 46, which directs a cutting jet of a suitable high pressure fluid, such as water from an above-ground source (not shown) into the mineral bed 14 to dislodge particles to be mined therefrom. The mining tool 38 may also include a plurality of nozzles such as the nozzle 46. The dislodged particles and the water form a slurry that is drawn into a plurality of orifices 48 for elevation to ground level by conventional pumping means (not shown). Removing the slurry from the cavity 26 increases the volume thereof so that air must be added through the conduits 24 to maintain the desired pressure.

The protective sleeve 33 extends through the casing 22 into the mining cavity 26. The lowermost end of the protective sleeve 33 is preferably 10 to 20 feet above the nozzles 46. The protective sleeve protects the drill string 34 and the mining tool 38 against damage that might result if a portion of the mineral formation 10 should collapse into the mining cavity. The protective sleeve 33 is raised as higher portions of the mineral deposit 14 are mined. The sleeve sections 33*a*, 33*b*, etc. are moved past the blowout protectors 40 in a manner similar to that described above for the sections of the drill string 34 with the attached dynamic seals 35.

After mining operations are complete, the drill string 34, mining tool 38 and protective sleeve 33 are removed from the casing 22. The upper casing sections 22*b*, 22*c*, etc. are rotated to disconnect them from the lowermost casing section 22*a*, which is ordinarily permanently set in the earth by the bonding agent. Therefore, the invention provides means for aligning and protecting the drill string 34 and mining tool 38 and requires a sacrifice of only one casing section.

The described embodiment is only exemplary of a presently preferred embodiment. Those skilled in the art may recognize modifications that are within the spirit of the invention. Accordingly, the true scope of the invention is to be determined with reference to the appended claims.

What is claimed is:

1. A borehole mining system for hydraulically mining an unconsolidated mineral deposit through a borehole into a cavity subjacent an overburden, comprising:

a casing for positioning in the borehole;

a drill string for extending through the casing between the ground surface and the cavity;

sealing means connected to the drill string between the drill string and the casing for retaining fluid pressure within the cavity while the drill string rotates within the borehole;

means for injecting a pressurized fluid into the cavity to provide a force for supporting the overburden above the cavity; and means for retaining fluid pressure within the cavity during vertical movement of the drill string within the borehole, wherein the retaining means comprises an annular balloon blowout protector positioned around the drill string and affixed to the casing, the annular balloon blowout protector and the sealing means being configured such that the annular balloon blowout protector may enclose sealing means during movement of the sealing means into or out of the borehole without substantial fluid pressure loss in the borehole and cavity.

2. The system of claim 1 further comprising a sleeve for extending through the casing to protect the drill string from damage caused by collapse of material into the borehole on cavity below the casing, the sleeve being slidable within the casing to project a predetermined distance below the casing into the cavity.

3. A borehole mining system for hydraulically mining an unconsolidated mineral deposit through a borehole into a cavity subjacent an overburden, comprising:

a casing for positioning in the borehole;

a drill string for extending through the casing between the ground surface and the cavity;

sealing means connected to the drill string between the drill string and the casing for retaining fluid pressure within the cavity while the drill string rotates within the borehole;

means for injecting a pressurized fluid into the cavity to provide a force for supporting the overburden above the cavity;

means for injecting a bonding agent into the mineral deposit to form an artificial consolidated zone above the cavity so that the pressurized fluid provides a supporting force to both the consolidated zone and the overburden, wherein the injecting means comprises a conduit extending between ground level and the cavity, wherein the conduit comprises a plurality of conduit sections, the conduit having one of the conduit sections fixed in the bonding agent and being threadedly connected to a conduit section above the artifically consolidated zone such that by rotation, the conduit sections above the artificially consolidated zone may be removed from the borehole.

4. A borehole mining system for hydraulically mining an unconsolidated mineral deposit through a borehole into a cavity subjacent an overburden, comprising:

a casing for positioning in the borehole, wherein the casing comprises a plurality of casing sections threadedly connected together with the lowermost threaded connection in the borehole being reverse threaded so that rotation of the casing at ground level disconnects the lowermost casing in the borehole from the remainder of the casings to permit their removal from the borehole;

a drill string for extending through the casing between the ground surface and the cavity;

sealing means connected to the drill string between the drill string and the casing for retaining fluid pressure within the cavity while the drill string rotates within the borehole; and means for injecting a pressurized fluid into the cavity to provide a force for supporting the overburden above the cavity.

5. A method for hydraulically mining an unconsolidated mineral deposit through a borehole into a cavity subjacent an overburden, comprising the steps of:

positioning a casing in the borehole;

inserting a conduit into the cavity through the borehole;

sealing the conduit and casing in the borehole;

fitting a drill string with at least one seal to retain fluid pressure in the cavity while the drill string rotates within the borehole;

inserting the drill string with a hydraulic mining tool mounted thereon in the casing so that the hydraulic mining tool extends into the cavity while the seal retains fluid pressure in the cavity;

injecting a pressured fluid into the cavity through the conduit to support the overburden; and forming a blowout seal on the casing around the drill string to permit vertical movement of the drill string within the borehole for retaining fluid pressure inside the cavity while permitting adjustments in the length of the drill string.

6. The method of claim 5 further including the step of inserting a sleeve into the casing to protect the drill string from damage if the material should collapse into the borehole or cavity below the casing.

* * * * *